US006634118B2

(12) United States Patent
Chen et al.

(10) Patent No.: US 6,634,118 B2
(45) Date of Patent: Oct. 21, 2003

(54) METHOD AND APPARATUS FOR VACUUM DRYING WOOD IN A COLLAPSIBLE CONTAINER IN A HEATED BATH

(75) Inventors: Zhangjing Chen, Blacksburg, VA (US); Fred M. Lamb, Christiansburg, VA (US)

(73) Assignee: Virginia Tech Intellectual Properties, Inc., Blacksburg, VA (US)

( * ) Notice: Subject to any disclaimer, the term of this patent is extended or adjusted under 35 U.S.C. 154(b) by 3 days.

(21) Appl. No.: 10/184,073

(22) Filed: Jun. 28, 2002

(65) Prior Publication Data

US 2003/0005597 A1 Jan. 9, 2003

Related U.S. Application Data

(60) Provisional application No. 60/303,099, filed on Jul. 6, 2001.

(51) Int. Cl.[7] ..... F26B 5/04

(52) U.S. Cl. ..... 34/412; 34/92; 34/519; 34/497

(58) Field of Search ..... 34/92, 406, 412, 34/497, 519, 219, 396

(56) References Cited

U.S. PATENT DOCUMENTS

| | | | | | |
|---|---|---|---|---|---|
| 3,811,200 | A | * | 5/1974 | Hager | 34/337 |
| 4,194,296 | A | * | 3/1980 | Pagnozzi et al. | 34/410 |
| 4,466,198 | A | * | 8/1984 | Doll | 34/257 |
| 4,620,373 | A | | 11/1986 | Laskowski et al. | 34/406 |
| 4,734,995 | A | | 4/1988 | Pagnozzi et al. | 34/406 |
| 4,893,415 | A | * | 1/1990 | Moldrup | 34/406 |
| 5,852,880 | A | * | 12/1998 | Harrison | 34/92 |

* cited by examiner

*Primary Examiner*—Denise L. Esquivel
*Assistant Examiner*—Kathryn S. O'Malley

(57) ABSTRACT

Wood is disposed in a container having at least one flexible wall, and vacuum is applied to the container. The flexible wall presses against a surface of the wood. The container and wood are them immersed in a heated bath (e.g. comprising water, air, or other fluids). The wood is heated by conduction through the flexible wall, and maintained at accurate temperature by the bath. The wood is thereby rapidly dried by heat and vacuum. The present invention is energy efficient, and provides rapid, uniform drying of the wood without checking.

30 Claims, 3 Drawing Sheets

Exemplary drying schedules

METHOD AND APPARATUS FOR VACUUM DRYING WOOD IN A COLLAPSIBLE CONTAINER IN A HEATED BATH

RELATED APPLICATIONS

The present application claims the benefit of priority from provisional patent application 60/303,099 filed on Jul. 6, 2001 now abandoned, which is hereby incorporated by reference.

Development of the present invention was supported in part by grant number 00-DG-112442425-192 from the U.S. Forest Service. The Government has certain rights in the invention.

FIELD OF THE INVENTION

The present invention relates generally to wood drying techniques. More specifically, the present invention relates to a vacuum drying technique for wood where the wood is placed in a collapsible, flexible container.

BACKGROUND OF THE INVENTION

Drying freshly cut wood is an essential step in producing lumber usable for construction and furniture. In the conventional technique for drying wood, the wood is placed in a kiln, and dry, heated air is circulated around the wood, slowly evaporating the moisture. Care must be taken so that the wood is not dried too fast, as this causes checking (cracking) of the wood due to nonuniform shrinkage. Kiln drying of wood tends to be costly, wasteful of energy, and slow. A large amount of heat energy is wasted by loss to the atmosphere; drying time can be about 2 months for a 4×4 inch piece of wood, for example.

To address the problems of energy consumption and speed, vacuum drying and radiofrequency drying have been developed. In vacuum drying, the wood is disposed in a vacuum chamber. Vacuum increases the evaporation rate, and greatly reduces the time required for drying. However, heat must be applied to the wood while in vacuum, which is problematic because vacuum prevents convection or conduction of heat energy to the wood. To overcome the problem of heating wood in vacuum, cyclical vacuum drying can be employed, in which the wood is alternatively heated in air, and exposed to vacuum, which cools the wood by evaporation. Cyclical vacuum drying is problematic because it tends to be slow, although it is still faster than conventional kiln drying.

In another known method, wood is heated internally by applying radiofrequency (RF) energy to the wood while it is in vacuum. RF/vacuum drying is problematic because it requires expensive electronic equipment and tends to cause nonuniform drying. Also, RF/vacuum drying requires heating by electrical energy, which is a relatively expensive form of heat energy (e.g., compared to heat from burning coal, oil, or natural gas). Other drawbacks of conventional vacuum drying techniques include the need for a large, rigid vacuum chamber, which is very expensive. It would be an advance in the art of wood drying to provide a wood drying technique that is fast, is energy efficient, does not require expensive equipment (e.g., RF generator or vacuum chamber), and provides improved drying uniformity compared to conventional wood drying techniques.

SUMMARY

The present invention includes an apparatus for drying wood having a vacuum-tight container for holding a piece of wood. The container has a flexible wall. A bath is provided for immersing the container and wood. A vacuum pump is provided for evacuating the interior of the container. Vacuum causes the flexible wall to press against the wood, thereby facilitating heat conduction from the bath to the wood. The bath can be heated.

The container can comprise a bag made with flexible walls. The bath can comprise water, air or other liquid. Also, the present device can have a heater for heating the bath. The bath can have a temperature in the range of 50–200 degrees or 60–180 degrees Fahrenheit, and the vacuum can be in the range of 0–400 Torr or 1–100 Torr (absolute pressure), for example.

A method of the present invention includes disposing a piece of wood in a container having a flexible wall, evacuating the container so that the flexible wall presses against the wood, and immersing the container and wood in a heated bath. The heated bath heats the wood through the flexible wall. The bath temperature can be in the range of about 50–200 degrees Fahrenheit or 60–180 degrees Fahrenheit, for example. The vacuum applied to the wood can be in the range of about 0–400 Torr or 0–100 Torr, for example.

DETAILED DESCRIPTION

The present invention provides a novel wood drying technique wherein wood is disposed in a flexible, impermeable, collapsible container, such as a plastic or rubber bag, or such as a rigid container with at least one flexible wall. Vacuum is applied to the wood in the container, thereby collapsing the container firmly against the wood. With vacuum applied, the container and wood are immersed in a heated bath, such as a flowing fluid, heated sand, or gas. Heat energy enters the wood by conduction through the container material because the container is in contact with both the wood and the heated material. The present invention obviates RF generators and rigid vacuum chambers. In a specific implementation of the present invention, the container and wood are disposed in a heated water bath.

Figure 1:
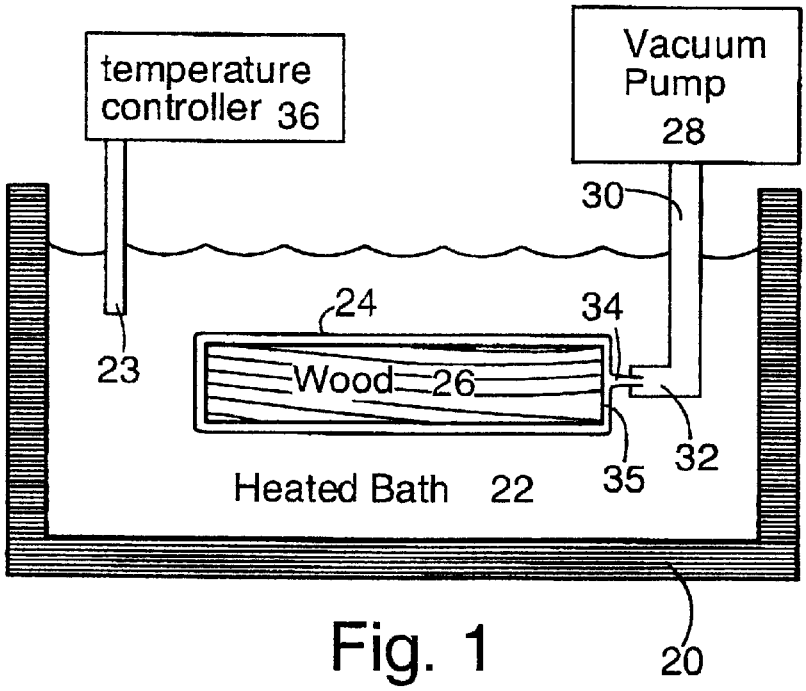
FIG. 1 shows an apparatus according to the present invention for drying wood.

FIG. 1 illustrates an apparatus for drying wood according to the present invention. A tank 20, holds a heated water bath 22. An impermeable bag 24 having flexible walls holds a piece of wood 26 to be dried. A vacuum pump 28 is connected to the bag 24 through a vacuum tube 30 so that an interior of the bag 24 is evacuated and the wood is exposed to vacuum.

The vacuum tubing 30 may be connected to the bag 24 with a reattachable connector 32, so that the vacuum pump can be disconnected from the bag 24. The connector 32 is attached to a vacuum port 34 of the bag 24.

A temperature controller 36 controls the temperature of the bath. The temperature controller includes a sensor (not shown) for sensing the bath temperature, and a heater 23 for supplying heat energy to the bath 22.

The bag 24 can be made of many different fluid-impervious materials such as polyvinyl chloride (PVC), rubber, Mylar (polyester film), and the like. The bag can be reinforced with fibrous material or fabric such as nylon. The bag 24 preferably has a resealable opening (not shown) for removing wood from and placing wood within the bag 24.

The heated bath 22 can comprise any flowable material, including liquids, oil, gas, air, sand and the like. In one embodiment of the present invention, the bath comprises water.

The vacuum pump 28 can be a conventional mechanical roughing pump and preferably should be able to tolerate moisture exposure.

In operation, wood 26 is disposed in the bag 24, and the bag is sealed fluid-tight around the wood 26. The vacuum pump 28 is connected to the vacuum port 34 via the tube 30 and connector 32. The bag 24 and wood 26 are then immersed in the bath 22. Vacuum is applied to the bag 24, causing the flexible walls of the bag 24 to collapse onto and press against the wood 26. The wood 26 and bath 22 are both in contact with the bag. The bath 22 is maintained at an elevated temperature (e.g. 60–180 degrees Fahrenheit). Also, the bath 22 is preferably circulated by a pump (not shown). Heat energy from the bath 22 is conducted through the bag 24 and into the wood 26. The temperature of the wood 26 can be accurately controlled by accurately controlling the bath temperature. Also, the temperature of the wood will be very uniform due to circulation of the bath 22.

Vacuum is continuously applied as the wood is held at elevated temperature. Moisture evaporating from the wood is extracted by the vacuum pump. The residual moisture content of the wood can be monitored using conventional techniques, such as by measuring electrical resistance of the wood. When a desired moisture level is reached, the wood is removed from the bag.

Preferably, the wood 26 is oriented within the bag so that a surface cut across the wood fibers 35 (e.g. surface cut perpendicular to the wood fiber, hereinafter referred to as 'cut-fiber end' 35) is disposed adjacent to the vacuum port 34. In other words, the wood is disposed so that the vacuum port is adjacent to the cut wood fibers. Orienting the wood in this way facilitates moisture removal from the wood, because wood typically has a much greater (e.g. 10,000–25,000 times greater) permeability in the direction of the wood fibers. However, it is noted that the present invention includes embodiments where the wood has any orientation with respect to the vacuum port 34.

The temperature of the heated bath 22 can have a wide range, for example a range of about 50–200 degrees Fahrenheit. More typically, however, the heated bath will have a temperature in the range of about 60–180 degrees Fahrenheit, or 90–150 degrees Fahrenheit. The best temperature of the bath depends on the shape, size, and species of the wood being dried, as well as the desired drying time and tolerance to checking.

Figure 2:
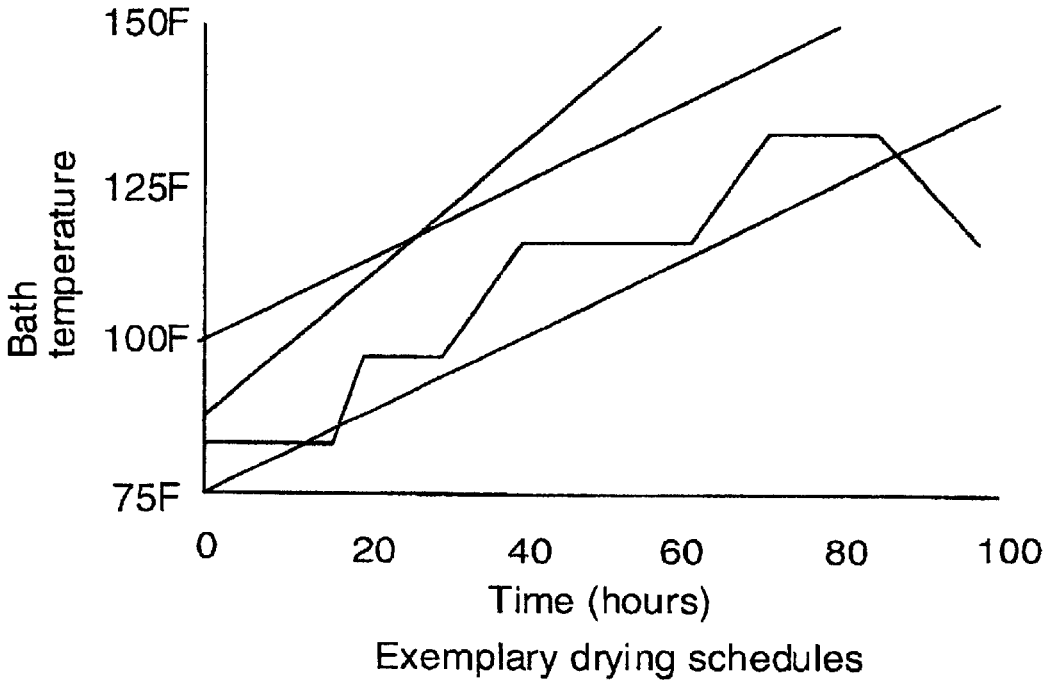
FIG. 2 illustrates exemplary drying schedules according to the present invention.

Additionally, the temperature of the heated bath 22 (and therefore the temperature of the wood 26) can be varied according to a drying schedule. Typically, the wood and bath temperature is increased during the drying process. FIG. 2 illustrates several exemplary drying schedules. Drying schedules according to the present invention can be stepped, or continuous, as shown in FIG. 2. The best drying schedule for a particular piece of wood will depend upon many factors, including the initial moisture content, shape, size, species, and permeability of the wood. Typically, drying schedules for thick pieces of wood will start at a lower temperature, and will require a longer drying time.

Alternatively, the wood and bath can be maintained at constant temperature during the drying process. It is noted that the drying schedules illustrated in FIG. 2 are merely exemplary and that the present invention can be implemented according to any time-versus-temperature drying schedule.

The vacuum pressure applied to the wood in the present invention can be in the range of about 0–400 Torr (all pressure figures herein are in absolute pressure). Typically, the vacuum applied will be less than 100 or 50 Torr. It is noted that the vacuum pressure can be varied according to a drying schedule. For example, the vacuum pressure can start at near atmospheric pressure or about 400 Torr and then decrease as the wood dries. A slowly decreasing vacuum pressure can help to provide uniform drying and prevent checking.

The drying time of the present invention can be for example about 60–100 hours for a 4 inch×4 inch piece of wood. This is much faster than kiln drying methods where drying a 4×4 inch piece of wood can take as long as 60 days (depending on the species). By applying uniform heat by conduction while exposing the wood to vacuum, the present invention provides exceptional drying uniformity at high speed. However, it is noted that the drying time of the present invention can be as short or as long as desired or needed. For example, if the present drying process is performed at relatively low temperature (e.g. 50 degrees Fahrenheit) and high vacuum pressure (e.g. 300 Torr), the drying time can be much longer, possibly even comparable to the time required for conventional kiln drying.

In the present invention, the container holding the wood (e.g. bag 24) must be flexible and must collapse under atmospheric pressure so that it is in contact with at least one surface of the wood 26. Direct contact between the container and wood 26 allows heat from the bath 22 to conduct through the container into the wood 26. If a void exists between the container and wood 26, heat will not be efficiently transported to the wood, and drying will be slow, and possibly nonuniform. Since a function of the container is to conduct heat, it is preferable for the container to have a relatively low thermal resistance. To provide low thermal resistance, the container can be very thin, or can have a high thermal conductivity, or a combination of the two. In any case, the container should be durable, and should not have any holes, particularly if the bath 22 comprises water. If the bath 22 comprises sand or air, then small holes in the container (e.g. from accidental damage or punctures) may be tolerable.

Figure 3:
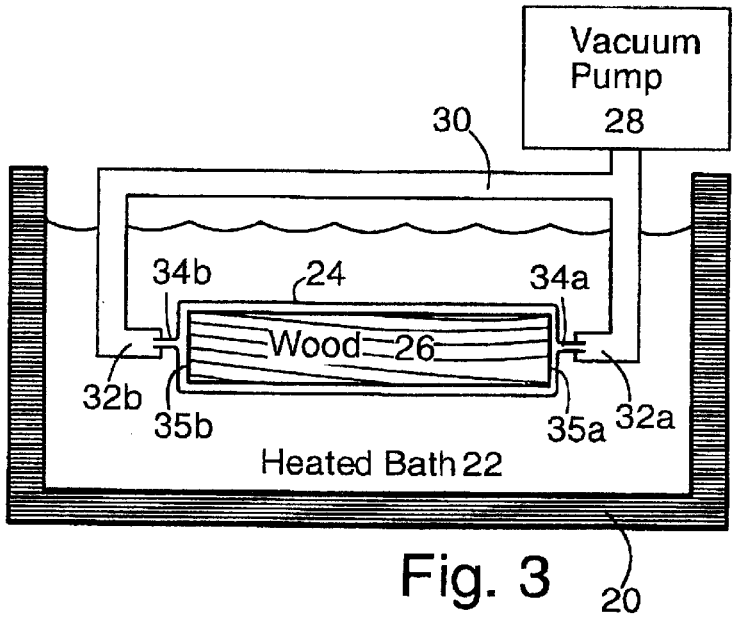
FIG. 3 shows an embodiment of the present invention where vacuum is applied to two ends of the wood.

FIG. 3 shows another embodiment of the present invention wherein vacuum tubing 30 is attached to both ends of the bag 24. Specifically, vacuum tubing 30 has two connectors 32*a*, 32*b* attached to two ports 34*a*, 34*b*. Preferably, the wood is disposed in the bag 24 so that the cut-fiber ends 35*a*, 35*b* are disposed adjacent to ports 34*a*, 34*b*. Proximity of the cut-fiber ends 35*a*, 35*b* to the ports 34*a*, 34*b* allows water vapor to exit the wood 26 from both cut-fiber ends, thereby providing more uniform drying compared to the apparatus of FIG. 1.

Figure 4A:
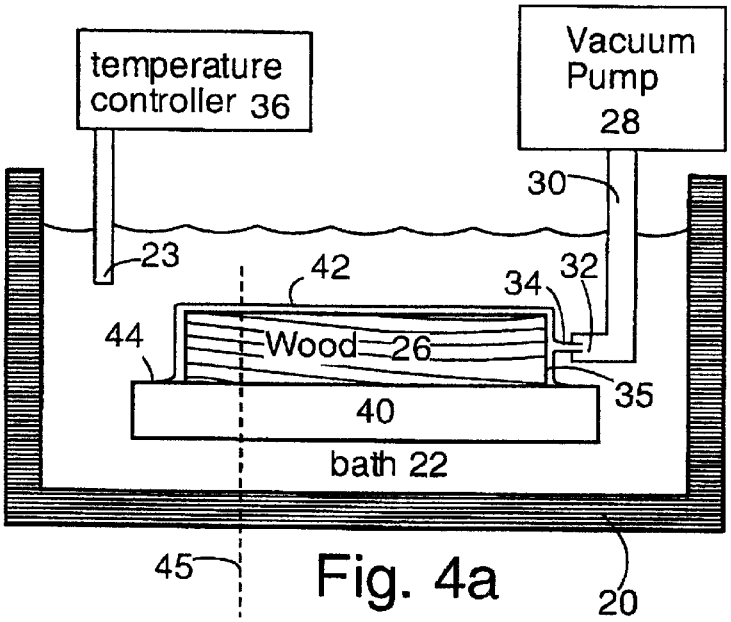
FIG. 4*a* shows an embodiment having a flexible sheet and a plate containing multiple pieces of wood.
Figure 4B:
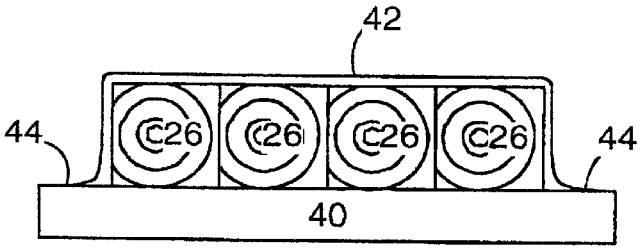
FIG. 4*b* shows a cross-sectional view cut through the wood and container of FIG. 4*a*.

FIG. 4*a* shows yet another embodiment of the present invention wherein the bag 24 of FIGS. 2 and 3 is replaced with a container comprising a plate 40 and flexible sheet 42. Four pieces of wood are disposed between the plate 40 and flexible sheet 42. FIG. 4*b* shows a cross sectional view cut through all four pieces of wood 26 along dotted line 45. Flexible sheet 42 is sealed around a perimeter 44 of the wood 26. The plate 40 and flexible sheet 42 thereby form a fluid impervious container for the wood 26. The flexible sheet 42 can be formed of the same materials disclosed above for the bag 24. The plate 40 can be made of metal (e.g. stainless steel), ceramic, plastic or any other rigid or semi-rigid fluid-impervious material. In operation, the volume between the flexible sheet 42 and plate 40 is evacuated, causing the sheet 42 to collapse onto the wood 26. The wood 26 is pressed against the plate. Heat is conducted into the wood 26 through both the flexible sheet and the plate 40.

In the present invention it is preferable (but not necessary) for multiple pieces of wood to be disposed in a single-layer, as illustrated in the lower portion of FIG. 4. A single-layer arrangement for multiple wood pieces allows every piece of wood to be exposed to heat from the bath on at least two sides. If all pieces of wood 26 have two sides with heat exposure, then drying will be more rapid and uniform. If multiple pieces of wood are stacked in a block, then it is possible for some pieces of wood to not have any direct contact with the bag 24, plate 40, or flexible sheet 42. This will tend to increase the drying time, and create nonuniform drying, which is undesirable.

It is also noted that if multiple pieces of wood are stacked in a block, then thermally conductive metal plates (e.g. comprising brass or steel) can be disposed between pieces of wood to facilitate heat distribution to pieces of wood in the middle of the block.

Figure 5:
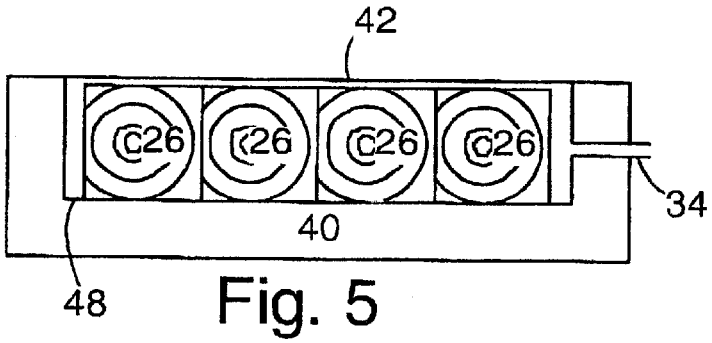
FIG. 5 shows an alternative embodiment of the container for use in the present invention wherein the container has sidewalls.

FIG. 5 shows an alternative embodiment of a wood container for use with the present invention wherein the plate 40 further comprises sidewalls 46. The flexible sheet 42 extends between the sidewalls 46. The vacuum port 34 can be disposed in the sidewall 46 as illustrated. In operation, the flexible sheet 42 presses the wood 26 onto a bottom surface 48 of plate 40, thereby assuring that each piece of wood is exposed to heat from two surfaces: bottom surface 48 and flexible sheet 42.

Figure 6:
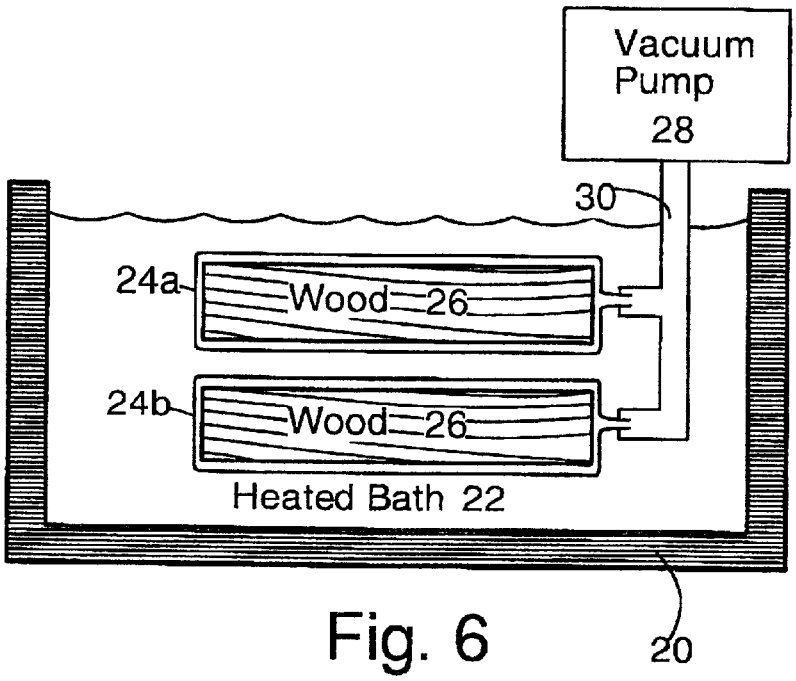
FIG. 6 shows an embodiment of the present invention wherein multiple containers are used in a single bath.

FIG. 6 shows an embodiment where two bags 24*a*, 24*b* are disposed in the same heated bath. Each bag 24*a*, 24*b* holds one or more pieces of wood. In large-scale application of the present invention, it is anticipated that many bags 24 will be used in a single bath 22. The use of many bags in a large bath increases the energy efficiency of the present invention. Each bag 24 may contain a single piece of wood, or several pieces of wood.

Figure 7:
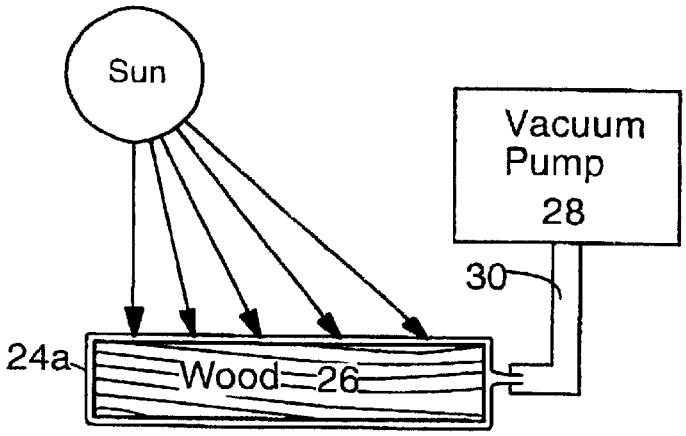
FIG. 7 shows another embodiment of the present invention wherein the wood is heated by exposing the container to sunlight.

FIG. 7 shows another embodiment of the present invention wherein the wood is heated by exposing the container to sunlight. The container can be a bag 24, or a plate in combination with a flexible sheet. In this embodiment, the container can have dark color so that it efficiently absorbs energy from the sun and becomes warm. Employing solar energy in this manner can provide exceptional energy efficiency.

The present invention provides exceptional energy efficiency because heat energy is confined to the bath, which can be insulated. The amount of heat energy lost to the atmosphere can be greatly reduced compared to conventional kiln drying. Also, the bath can be heated from a coal, gas or oil burner, instead of electricity, which is much more expensive. However, it is noted that the present invention includes the possibility of heating the bath using electrical energy (e.g. by resistance heating).

It is noted that the bath is preferably circulated around the wood. Circulation improves heat conduction to the wood, and improves the uniformity of the wood temperature. The bath can be circulated by a pump, fan, agitator or the like.

It is noted that the bath 22 does not necessarily need to be actively heated. For example, the bath 22 temperature can be maintained by the ambient environment (e.g. at 70–80 degrees). Ambient temperature can be warm enough to promote evaporation of moisture from the wood 26, since water has a greatly reduced boiling temperature in vacuum. Additionally, the container and wood can be heated using geothermal energy, such as from a hot spring or steam vent.

It will be clear to one skilled in the art that the above embodiment may be altered in many ways without departing from the scope of the invention. Accordingly, the scope of the invention should be determined by the following claims and their legal equivalents.

What is claimed is:

1. An apparatus for vacuum drying wood, comprising:

a) at least one vacuum-tight container having at least one flexible wall for holding at least one piece of wood;

b) a thermal heat source for heating the wood by conduction through the flexible wall;

c) a vacuum pump for connection to the vacuum-tight container.

2. The apparatus of claim 1 wherein the vacuum-tight container comprises a bag having flexible walls.

3. The apparatus of claim 1 wherein the thermal heat source comprises a bath.

4. The apparatus of claim 3 further comprising a heater for heating the bath.

5. The apparatus of claim 3 wherein the bath comprises water.

6. The apparatus of claim 3 where in the bath comprises heated air.

7. The apparatus of claim 3 wherein the bath has a temperature in the range of 60–180 degrees Fahrenheit.

8. The apparatus of claim 1 wherein the thermal heat source comprises an ambient environment.

9. The apparatus of claim 1 further comprising a piece of wood disposed in the container.

10. The apparatus of claim 1 wherein the vacuum-tight container comprises a plate and a flexible sheet.

11. The apparatus of claim 1 wherein the container contains a vacuum in the range of 0–400 Torr.

12. An apparatus for vacuum drying wood, comprising:

a) at least one vacuum-tight container having at least one flexible wall for holding at least one piece of wood;

b) a bath for immersing the container and wood;

c) a vacuum pump for connection to the vacuum-tight container; and d) a heater for heating the bath.

13. The apparatus of claim 12 wherein the vacuum-tight container comprises a bag having flexible walls.

14. The apparatus of claim 12 wherein the bath comprises heated water.

15. The apparatus of claim 12 further comprising a piece of wood disposed in the container.

16. The apparatus of claim 12 wherein the vacuum-tight container comprises a plate and a flexible sheet.

17. The apparatus of claim 12 wherein the bath has a temperature in the range of 60–180 degrees Fahrenheit.

18. The apparatus of claim 12 wherein the container contains a vacuum in the range of 0–400 Torr.

19. A method for vacuum drying of wood, comprising the steps of:

a) disposing at least one piece of wood in a vacuum-tight container having at least one flexible wall;

b) applying a vacuum to the container so the flexible wall presses against the wood;

c) heating the wood by conducting heat through the flexible wall.

20. The method of claim 19 wherein the vacuum applied is in the range of 0–400 Torr.

21. The method of claim 19 wherein the wood is disposed in the container so that vacuum is applied to cut-fiber ends of the wood.

22. The method of claim 19 wherein the wood is heated by immersing the container and wood in a heated bath.

23. The method of claim 22 wherein the heated bath has a temperature in the range of 50–200 degrees Fahrenheit.

24. The method of claim 22 wherein the heated bath has a temperature in the range of 70–150 degrees Fahrenheit.

25. The method of claim 22 wherein the heated bath has a temperature that increases during drying.

26. The method of claim 19 wherein the wood is heated by exposing the container to sunlight.

27. An apparatus for vacuum drying wood, comprising:

a container of sufficient size to hold wood to be vacuum dried, said container being vacuum tight, and wherein at least a portion of said container is sufficiently flexible so as to collapse against wood held within said container under the influence of vacuum pressure exerted inside said container, and where said at least a portion of said container is constructed from a material and is of a thickness which allows heat transfer from an ambient environment in which said container is located to said wood held within said container when said at least a portion of said container is collapsed against wood held within said container; and a means for connecting a vacuum source to said container.

28. The apparatus of claim 27 wherein the container comprises a bag with flexible, impermeable walls.

29. The apparatus of claim 27 wherein the container comprises a plate and a flexible sheet.

30. The apparatus of claim 27 wherein the container is resealable.

* * * * *